US007798619B2

(12) United States Patent
Diederen

(10) Patent No.: US 7,798,619 B2
(45) Date of Patent: Sep. 21, 2010

(54) PRINTING DEVICE, FLEXIBLE RESERVOIR AND WORKING CONTAINER AND FEED SYSTEM

(75) Inventor: Jacobus Henricus Diederen, Cuijk (NL)

(73) Assignee: Stork Digital Imaging B.V. (NL)

( * ) Notice: Subject to any disclaimer, the term of this patent is extended or adjusted under 35 U.S.C. 154(b) by 495 days.

(21) Appl. No.: 10/553,103

(22) PCT Filed: Apr. 14, 2004

(86) PCT No.: PCT/NL2004/000249

§ 371 (c)(1),
(2), (4) Date: Nov. 14, 2005

(87) PCT Pub. No.: WO2004/091921

PCT Pub. Date: Oct. 28, 2004

(65) Prior Publication Data

US 2006/0268082 A1 Nov. 30, 2006

(30) Foreign Application Priority Data

Apr. 17, 2003 (NL) ..... 1023215

(51) Int. Cl.
*B41J 2/17* (2006.01)

(52) U.S. Cl. ..... 347/84; 347/85; 347/86; 347/66; 347/7

(58) Field of Classification Search ..... 347/92, 347/84–87, 7, 6, 100, 66, 94, 14
See application file for complete search history.

(56) References Cited

U.S. PATENT DOCUMENTS

| | | | | |
|---|---|---|---|---|
| 3,708,798 | A * | 1/1973 | Hildenbrand et al. | 347/86 |
| 4,277,791 | A * | 7/1981 | Rosenstock et al. | 347/86 |
| 4,432,005 | A | 2/1984 | Duffield et al. | |
| 4,441,422 | A * | 4/1984 | Dreeben | 101/125 |
| 4,959,667 | A * | 9/1990 | Kaplinsky | 347/87 |
| 5,650,811 | A * | 7/1997 | Seccombe et al. | 347/85 |
| 5,751,321 | A * | 5/1998 | Erickson | 347/85 |
| 6,193,354 | B1 * | 2/2001 | Ito | 347/30 |
| 6,267,474 | B1 * | 7/2001 | Mochizuki | 347/86 |
| 6,422,674 | B1 * | 7/2002 | Hinami et al. | 347/7 |
| 7,080,899 | B2 * | 7/2006 | Yoshizawa et al. | 347/100 |
| 2002/0127066 | A1 * | 9/2002 | Mitchell et al. | 406/38 |
| 2002/0158950 | A1 * | 10/2002 | Altendorf | 347/92 |
| 2003/0052950 | A1 * | 3/2003 | Ohashi et al. | 347/85 |
| 2003/0071722 | A1 * | 4/2003 | Cole | 340/431 |

FOREIGN PATENT DOCUMENTS

| | | |
|---|---|---|
| EP | 0 857 573 A2 | 8/1998 |
| EP | 0 927 638 A2 | 7/1999 |
| EP | 1 013 449 A2 | 6/2000 |
| EP | 1 273 451 A2 | 1/2003 |
| JP | 11-105299 | 4/1999 |
| JP | 2003-118134 | 4/2003 |
| WO | WO 03/076194 | 9/2003 |

* cited by examiner

*Primary Examiner*—Matthew Luu
*Assistant Examiner*—Henok Legesse
(74) *Attorney, Agent, or Firm*—Hoffmann & Baron, LLP

(57) ABSTRACT

In a printing device (10) of the piezoelectric DOD type for printing a substrate (12) with a printing medium, comprising a print head (16), which is arranged in such a manner that it can be moved to and fro substantially transversely with respect to the direction in which the substrate to be printed is conveyed, the working container (30) for degassed printing medium is coupled to a flexible reservoir (32). This results in increased productivity.

15 Claims, 2 Drawing Sheets

PRINTING DEVICE, FLEXIBLE RESERVOIR AND WORKING CONTAINER AND FEED SYSTEM

CROSS-REFERENCE TO RELATED APPLICATIONS

This application is the National Stage of International Application No. PCT/NL2004/000249, filed Apr. 14, 2004, which claims the benefit of Netherlands Application No. NL 1023215, filed Apr. 17, 2003, the contents of which is incorporated by reference herein.

FIELD OF THE INVENTION

A first aspect of the invention relates to a printing device for printing a substrate with a printing medium using the "drop-on-demand" principle, comprising a print head, which is arranged in such a manner that it can be moved to and fro substantially transversely with respect to the direction in which the substrate to be printed is conveyed and has at least one spray nozzle with an interacting piezoelectric element for generating and releasing a drop of the printing medium on demand, the spray nozzle being in communication with a flexible working container, which is arranged at a fixed position, for degassed printing medium at a working height with respect to the spray nozzle which working height lies within a predetermined height range, in order to keep the pressure of the printing medium in the print head within a predetermined pressure range.

BACKGROUND OF THE INVENTION

A printing device, known in the art as a "piezo-DOD inkjet printer", generally includes a print head, which is arranged on a carriage which can move to and fro transversely with respect to the direction of movement of the substrate which is to be printed. The print head includes at least one spray nozzle, generally a number, for example 8 or 16, for each colour, this nozzle being in communication with a flexible working container via a feed passage. Furthermore, the print head for each spray nozzle includes a piezoelectric element for generating ink drops. A shockwave can be generated electrically in the print head by means of the piezoelectric element, with the result that each time each shockwave forms a drop from the printing medium. A drop of this type is only formed if it is required in order to print the substrate. This principle has been given the name drop-on-demand. In addition to "piezo-DOD", "thermal DOD" is also known, in which heating elements are used instead of a piezoelectric element to form drops.

It is generally recognized in the art that degassed printing medium is required for piezo-DOD. If printing medium which has not been degassed (for conventional types of ink the equilibrium concentration of oxygen is approx. 8 mg of $O_2$/l at atmospheric pressure) is used, at high firing frequencies the gas accumulates in the print head, where the accumulated gas attenuates the shockwaves which bring about the formation of drops. The result of this is that after a certain time has elapsed, fewer drops are formed, or even no more drops will be formed, and the inkjet printer starts to malfunction or even stops altogether. With printing medium which has not been degassed, this phenomenon means that it is necessary either to use lower firing frequencies or to periodically interrupt printing operation in order to remove the accumulated gas, generally by purging. Both solutions reduce the productivity of the printing device. If degassed ink is used, this phenomenon, and the associated adverse effects, do not occur. For example, degassed printing medium has an oxygen concentration of approximately 1 mg/l. If degassed printing medium is in contact with air for approximately one day, the oxygen concentration returns to the abovementioned equilibrium value. Therefore, contact with air has to be avoided, although brief contact is acceptable.

The degassing of the printing medium may be carried out on line during printing, for example just before the printing medium is supplied to the print head or in the print head itself. The latter option is used in particular in relatively large industrial printing devices. Another possibility is to use printing medium which has already been degassed, a solution which is adopted in particular for relatively small standard printing devices. This imposes higher demands on the packaging, in particular with regard to its gas and/or air permeability. Examples of packaging of this nature are described in European patent applications 857 573 and 1 013 449.

In a type of piezo-DOD printing device as described above, the working container, which is flexible (not dimensionally stable) with a view to allowing it to empty out without the admission of air, is arranged at a fixed position and connected to the print head by means of a flexible line of sufficient length, since allowing the working pouch to move with the print head, for example on the carriage, can lead to undesirable fluctuations in the pressure of the printing medium in the print head, and therefore to a non-uniform print quality. The known working container has a relatively small volume (of the order of magnitude of a few hundred millilitres), since the pressure in the print head is related to the pressure exerted by the printing medium (volume and working height with respect to the print head), and consequently frequent replacement by operating staff is required. The printing device has to be stopped for this purpose.

Furthermore printing devices are known in the art, which are provided with feed systems, mostly controlled by valves, for feeding a printing medium from a reservoir to a working container. Examples thereof are known from e.g. JP-A-11105299, EP-A-0 927 638 and JP-A-2003118134. The complexity, costs and susceptibility to disturbances of the printing device are increased by such systems.

SUMMARY OF THE INVENTION

It is a desirable aspect of the present invention to provide a piezo-DOD printing device which can print for a long time. A further desirable aspect of the invention is to provide a device of this type in which, during operation, if necessary, it is possible to top up or replace the supply of printing medium. Yet a further desirable aspect is to maintain the degassed state of the printing medium. Yet another desirable aspect is to provide a piezo-DOD printing device which comprises a relatively simple, insensitive to disturbances, and inexpensive feed system for printing medium in order to allow continuous printing of a substrate with the printing medium.

This desirable aspect is achieved, in a printing device of the type described in the preamble, by virtue of the fact that the working container is in communication with a releasable, flexible reservoir for degassed printing medium. According to the invention, the total stock of printing medium is formed by the content of the relatively small working container and the content of a relatively large reservoir, which may have a volume of, for example, a few liters. The working container and the reservoir form communicating vessels during normal operation due to the open connection between them. During printing, printing medium which is required flows out of the working container towards the print head for use in the printing process. The working container, on account of the communication with the reservoir as communicating vessels, is automatically topped up from the reservoir, with the pressure of the printing medium in the print head being kept within a defined pressure range as a result of the pressure exerted by the stock of printing medium. As a result of the open connection the liquid pressure at a certain height in the reservoir is equal to the liquid pressure at the same level in the working container. This does not apply, if between the respective containers valves, shut-off means and closing devices are present, which are controlled, and/or consecutively and repeatedly closed and opened during operation. In the printing device according to the invention an equilibrium is established between the hydrostatic pressures and height levels of the printing medium in the containers by means of free liquid exchange due to the open connection during operation. Since the reservoir and the working container are arranged at a fixed position, when the reservoir is empty the latter can be uncoupled. There is no need to interrupt operation of the printing device to do this, since the quantity of printing medium which is present in the working container functions as a buffer which is sufficient to cover the time required for replacement. Therefore, the reservoir can be changed during operation ("on the fly"). During this brief exchange of the reservoir, the open connection between the reservoir and the working container is temporarily interrupted, for example by means of a open/closed valve.

In the printing device according to the invention both the working container and reservoir are flexible and suitable for degassed printing medium. A dimensionally stable container does not allow to maintain the printing medium in a degassed state during operation of the printing device, because during operation in that situation either an underpressure is generated in the container that causes the printing process to stop because printing medium is no longer delivered, either air is sucked in from the environment into the container, which air contacts the printing medium thereby removing its degassed state.

In other words, during operation of the device according to the invention the working container is continuously in open connection with the reservoir, except during exchanging or replacing the reservoir. During such an exchange, the entry of air into the working container is prevented.

To promote this emptying of the printing medium, the reservoir is advantageously positioned at a height difference, generally a relatively small height difference, above the working container. In this preferred embodiment, the bottom of the reservoir is located at a slightly higher level than the bottom of the working container, so that during operation the reservoir empties out slightly earlier than the working container. The working height of the working container and the height difference between the reservoir and the working container are determined by the pressure in the print head, which has to be sufficient to form and release drops in the event of the piezoelectric element being activated and to keep the feed passage of the print head full. If the reservoir is positioned at an excessively high position, the pressure exerted in the print head by the printing medium will be so great that printing medium will leak out of the spray nozzle. If the reservoir is positioned at an excessively low position, the meniscus of the printing medium will break in the print head during the suction movement of the piezoelectric element. In the event of an extremely low pressure in the print head (as a result of a very low position of the working container), there is a risk of air being sucked in from the environment through the spray nozzle. In the printing device according to the invention, no additional means, such as pumps and the like, are used to feed the printing medium to the print head from the working container or to feed printing medium from the reservoir to the working container.

Since the reservoir has a relatively large volume, the decrease in the quantity of printing medium therein as a result of a drop in level during printing can have a relatively extensive influence on the pressure in the print head. As an additional measure to the height difference between the flexible reservoir and the working container and print head, the reservoir advantageously has a low shape, i.e. a small height dimension, so that the drop in the level of the printing medium in the reservoir which occurs during printing does not have any unacceptable effect on the pressure in the print head. A narrow reservoir is preferred, with a view to materials costs. In addition, this allows a plurality of reservoirs, one for each colour, to be positioned laterally next to one another over a relatively short length. For a given delivering volume, a preferred reservoir is a low, narrow and long pouch.

To promote the outflow of the printing medium when the quantity of printing medium in the reservoir decreases during operation, in particular when the reservoir is virtually empty, a preferred embodiment of the printing device according to the invention is provided with displacement means for moving the reservoir upwards with respect to the working container, in particular that end of the reservoir which is remote from the working container. In this way, the level of the printing medium in the reservoir with respect to the working container can be monitored and controlled within predetermined permissible limits.

According to a further embodiment, the displacement means comprise support means, which can be tilted in the direction of the working container, for supporting the reservoir. Tilting causes the outlet opening of the reservoir to remain at approximately the original position with respect to the working container, while the drop in level of the printing medium is compensated for by tilting. The support means advantageously comprise a support plate which can rotate about a rotation point located in the vicinity of the end which faces the working container, and at the opposite end is connected to counter-pressure means, such as a counter-pressure spring, and which in the horizontal position bears against supporting means, for example a (fixed) support point below the support plate, or a (fixed) support point located above it in the vicinity of that end of the support plate which faces towards the working container. Since the mass of the support means and the reservoir with contents positioned thereon gradually decreases during operation, after a limit value which is defined by the counter-pressure means has been exceeded, the support means are gradually tilted about the rotation point by the counter-pressure means.

This displacement is advantageous in particular if the reservoir is virtually empty, so that even the final residues can flow out of the reservoir. Prior to this displacement, the reservoir is lying in a substantially horizontal position against the supporting means.

Advantageously signalling means for remote detection of tilting of the support plate are provided. In addition to visual detection of the tilting by the operating staff, the signalling means can, for example, produce a light or sound signal in order to notify the operating staff. This is advantageous in particular if one operator is responsible for a plurality of printing devices. The moment of tilting can be adjusted by adapting the various components to one another in such a way that the remainder of the reservoir then flows into the working container within a relatively short time. In other words, the residual quantity of printing medium in the reservoir, when the tilting commences, can be adjusted by means of the counter-pressure means. This tilting moment then indicates that replacement of the reservoir is required. The signalling means can be connected to a detection switch which is energized in the event of tilting.

The modification of a conventional piezo-DOD printing device in accordance with the invention allows the uninterrupted operating time to be considerably lengthened, for example to 10 hours compared to an operating time of 2-3 hours for a printing device according to the prior art, while the pressure in the print head can be maintained within accurate limits, so that there are no changes in the print quality and ink yield during the operating period. Existing piezo-DOD devices can easily be adapted in accordance with the invention (retrofitting). It is merely necessary to adapt the working container cartridge by the provision of an additional connection or coupling to the reservoir. The electronics and control technology of the printing device remain unaffected.

The flexible reservoir is advantageously made from a metalized plastic film which is gas-impervious. It is more preferable for the material of the flexible reservoir to have a sandwich structure. An aluminium barrier layer which is provided with a polyethylene or polypropylene film on both sides is one suitable example. The thickness of the reservoir is such that the reservoir is sufficiently flexible to adapt to the change in volume which occurs during printing, in order to maintain the degassed state of the printing medium without any ingress of air. According to a further preferred embodiment, the height dimension (thickness) of the reservoir in the completely filled state is smaller than the height dimension of the working container. In a situation of this nature, if the reservoir is positioned at a working height which is slightly above the bottom of the working container, the pressure in the print head cannot depart from the design limits of the printing device.

The reservoir advantageously comprises a front surface and a rear surface, which are connected to one another along the periphery, with an outlet opening, which is in fluid communication with connecting means for coupling to the working container, being provided in a peripheral part. It is advantageous to use gas-impervious couplings, for example made from PVdF or plastic which is itself insufficiently gas-impervious but has been provided with a barrier layer. For rapid coupling, the connecting means of the reservoir and of the working container are advantageously quick-fit couplings, comprising complementary parts, which are known per se.

To enable the printing medium to flow out correctly, the said peripheral part is preferably shaped in such a manner that the inner wall of the reservoir has a gradual transition in the direction of the outlet opening. One possibility in this respect, in the case of an elongate and rectangular reservoir, is for the corners of a rectangular front and rear surface to be connected to one another along a curved line at the said peripheral part, generally the top side. As has already been discussed above, in the filled state the flexible reservoir is advantageously a long, low and narrow pouch. According to a particularly preferred embodiment, the ratio of the length of a front surface of the reservoir to its width is greater than 2.5, more preferably greater than 3.

A further aspect of the invention relates to a flexible reservoir, filled with degassed printing medium, in particular obviously intended for a printing device according to the invention, which reservoir comprises a front surface and a rear surface made from a gas-impervious, metalized plastic film, which are connected to one another along the periphery, a closable outlet opening with connecting means for coupling to the working container being provided in a peripheral part. Preferred embodiments of this reservoir are defined in the dependent claims. To protect the reservoir during storage and transport and to improve its handling properties, the flexible reservoir can be packed in a protective packaging, such as a (cardboard) box, in which case only the connecting means project out of the packaging. The abovementioned support means are in this case preferably designed in such a manner that the reservoir with protective packaging is placed directly into or onto them.

Yet another aspect of the invention relates to a flexible working container for degassed printing medium, in particular obviously intended for use for a printing device according to the invention, comprising a flexible container made from a gas-impervious, metalized plastic film, a first peripheral part of which is provided with an outlet opening with connecting means for coupling to a feed leading to a print head, and a second peripheral part of which is provided with an inlet opening with connecting means for coupling to a reservoir. When the working container according to the invention is in use, printing medium flows through it (semi-)continuously, so that no "old" ink or other printing medium remains behind in it. In this way, the working stock is continuously refreshed.

Yet a further aspect of the invention relates to a feed system for feeding a printing medium to a printing device, in particular obviously intended for a printing device according to the invention, which comprises a flexible reservoir according to the invention which is operatively connected to a working container according to the invention.

BRIEF DESCRIPTION OF THE DRAWINGS

The present invention is illustrated herein below on the basis of the appended drawing, in which.

DETAILED DESCRIPTION OF PREFERRED EMBODIMENTS

Figure 1:
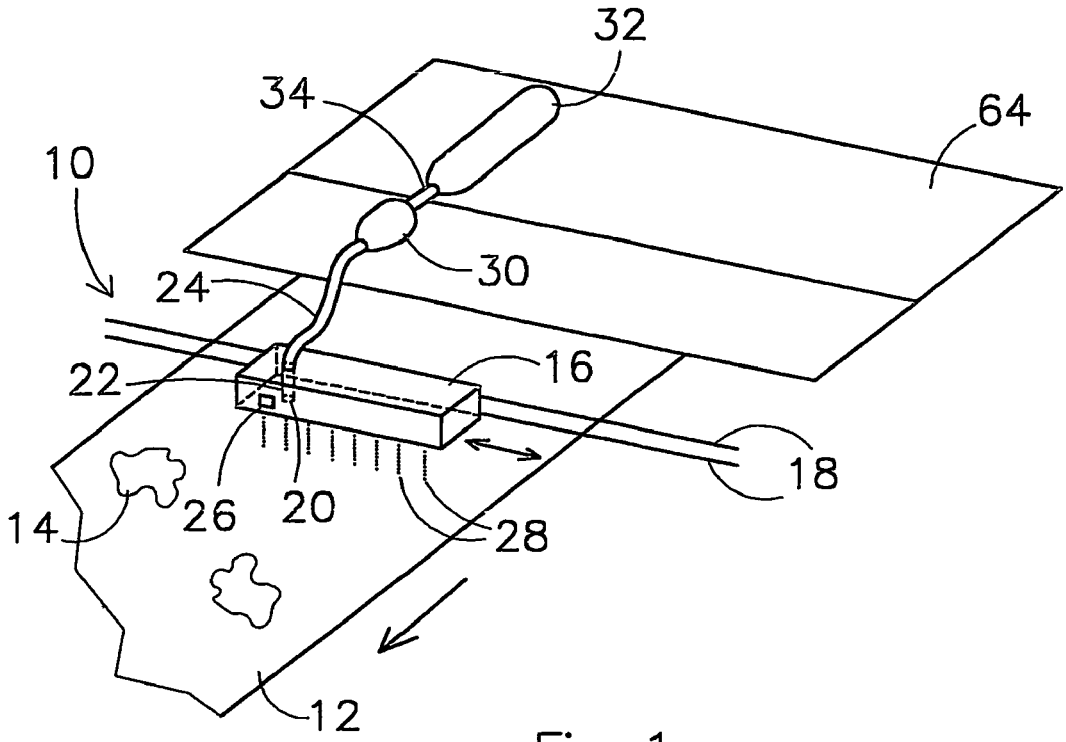
FIG. 1 diagrammatically depicts an embodiment of a printing device according to the invention.

In FIG. 1, a piezo-DOD printing device according to the invention is denoted overall by reference numeral 10. The printing device 10 is used for the continuous printing of a substrate 12 in web form which is conveyed through the printing device with, for example, a repeating pattern of printed images 14. The conveying direction of the substrate is denoted by a single arrow. For the sake of simplicity, the means for conveying the substrate, such as one or more driven rollers, are not shown. The printing device 10 comprises a print head 16, which is arranged on a carriage (not shown). The carriage can move to and fro in a transverse direction (as indicated by a double arrow) with respect to the conveying direction of the substrate, along rails 18 via a suitable drive (not shown), such as a toothed belt drive. One or more spray nozzles 20 are provided for each colour, such as black, magenta, yellow and cyan, in the print head 16, which nozzles are connected, via a feed passage 22 in the print head 16, to a flexible feed line 24 (only one of which is shown). A piezoelectric element 26 is provided in the vicinity of that end of the feed passage 22 which lies at the spray nozzle 20. The element 26 is energized on demand in order to generate shockwaves in the printing medium which is present in the feed passage 22 and in this way to form drops 28. The flexible feed line 24 is in turn in communication with a working pouch 30 for degassed printing medium, such as degassed printing ink. This working pouch 30 is arranged at a fixed working height with respect to the print head 16. A flexible reservoir 32 according to the invention is also arranged at a fixed position and is connected to the working pouch 30 via a flexible connection 34.

Figure 2:
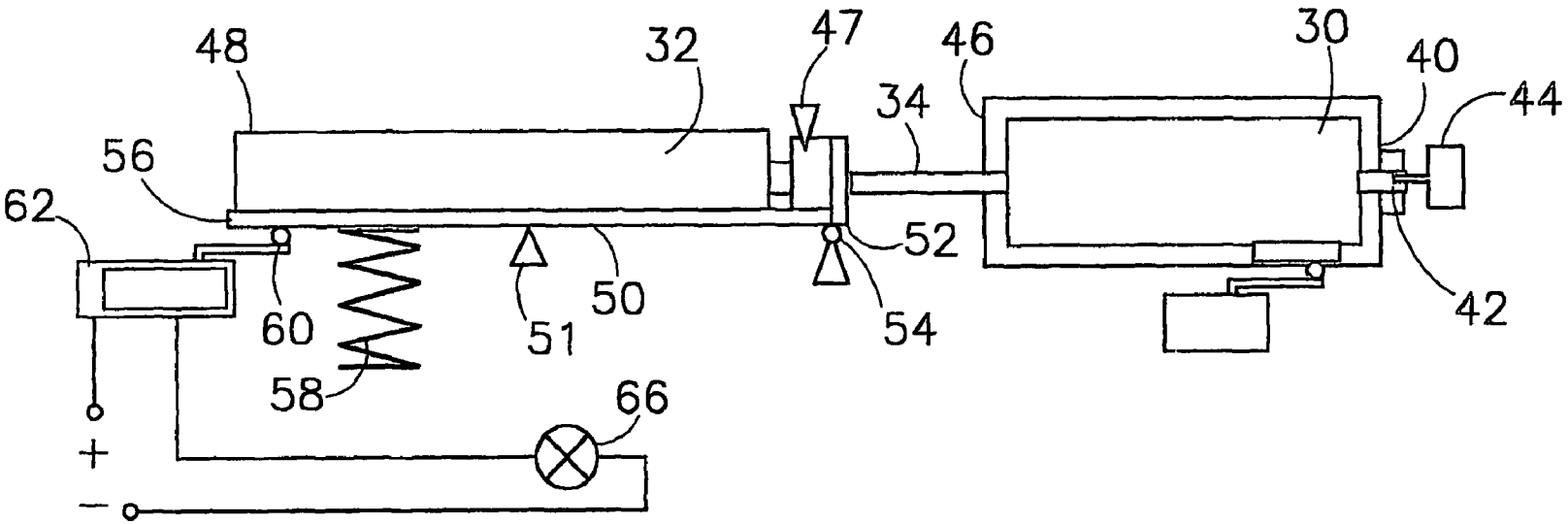
FIG. 2 diagrammatically depicts an embodiment of a feed system according to the invention.

FIG. 2 diagrammatically depicts an embodiment of a feed system according to the invention in more detail. Those components which correspond to FIG. 1 are denoted by the same reference numerals. The working pouch 30 with a relatively small volume of, for example, 300 ml is arranged at a fixed position and at a predetermined working height with respect to the print head. This working height lies within a predetermined height range, the limits of which are determined by the print head. On the one hand, ink leaks out of the print head if the working pouch is positioned at an excessively high working position with respect to the print head. On the other hand, the meniscus of the printing medium in the print head breaks during the suction movement of the piezoelectric element if the working pouch is positioned at an excessively low working height with respect to the print head. In the event of extremely low pressures entailed by an extremely low position of the working pouch, the working pouch may even suck printing medium out of the print head, so that air is sucked into the print head itself. On an exit side 40 of the working pouch 30, the latter is provided with an outlet opening 42 which is connected to, for example, a needle connection 44 of the feed passage of the print head. On the opposite side 46, the working pouch 30 is connected to the flexible reservoir 32 via a releasable coupling 34, optionally provided with a open/closed shut-off means 47. The flexible reservoir 32 is arranged in a box-like body 48 which protects the reservoir 32 from damage, both during storage and transport and during operation. The elongate reservoir 32 is supported by a support plate 50 which extends in the longitudinal direction of the reservoir 32 and of which the end 52 facing the working pouch 30 is supported on a rotation point 54 or connected to a pivot pin. At the other end 56, the support plate 50 is supported by a counter-pressure spring 58, which is depressed by the weight of the support plate 50 in conjunction with the flexible reservoir 32, the contents of the latter and the box-like protective body 48. Furthermore, in the vicinity of this end, there is a switch 62 which is energized via a lever 60. In the horizontal position, approximately in the centre, the support plate 50 rests on a support point 51. The rotation point 54, support point 51 and the counter-pressure spring 58 can be secured to a table 64 of adjustable height (FIG. 1). To keep the pressure of the printing medium in the print head within accurately defined limits, the support plate 50 (and therefore the flexible reservoir with printing medium) is placed at a fixed height with respect to the working pouch 30. In an embodiment of a printing device which is supplied by the Applicant under the trade name "Sapphire", after this printing device has been modified in accordance with the invention the underside of the flexible reservoir 32 will lie approx. 3.5 cm above the underside of the working pouch 30. The shape of the reservoir 32 is such that in the completely filled state the top side of the reservoir 32 lies within a margin of 5 cm from the bottom of the reservoir 32. The reason for this is that the pressure in the print head during the emptying of the working pouch 30 and the reservoir 32 is to remain stable within 5 cm water column in this type of printing device. For a relatively large stock volume of printing medium in the reservoir 32, the reservoir takes the form of a relatively long, narrow and low pouch, for example with dimensions of 500×150 mm for a filling volume of approx. 2 litres. During printing, over the course of time the flexible reservoir 32 will gradually empty out and become lighter, so that the spring force exerted by the counter-pressure spring 58 will at a given moment be sufficient to lift the support plate 50 out of the horizontal position and to tilt it about the rotation point 54. This tilting actuates the switch 62, so that a signal lamp 66 lights up. One end 56 of the support plate 50, after the weight of the latter on the counter-pressure spring 58 has dropped below the counter-force exerted by the counter-pressure spring, will gradually tilt upwards, under the influence of the counter-pressure spring 58, about the rotation point 54 at the other end of the support plate 50. This promotes complete emptying of the reservoir 32, while the pressure at the print head remains within the required pressure range. The switch 62 detects that the quantity of printing medium in the reservoir 32 has almost run out and an alarm via the signal lamp 66 is used to warn operating staff that the reservoir 32 needs to be replaced. Since there is still a stock of printing medium in the working pouch 30, which functions as a buffer, there is no need to interrupt operation of the printing device itself in order to carry out this replacement.

Figure 3:
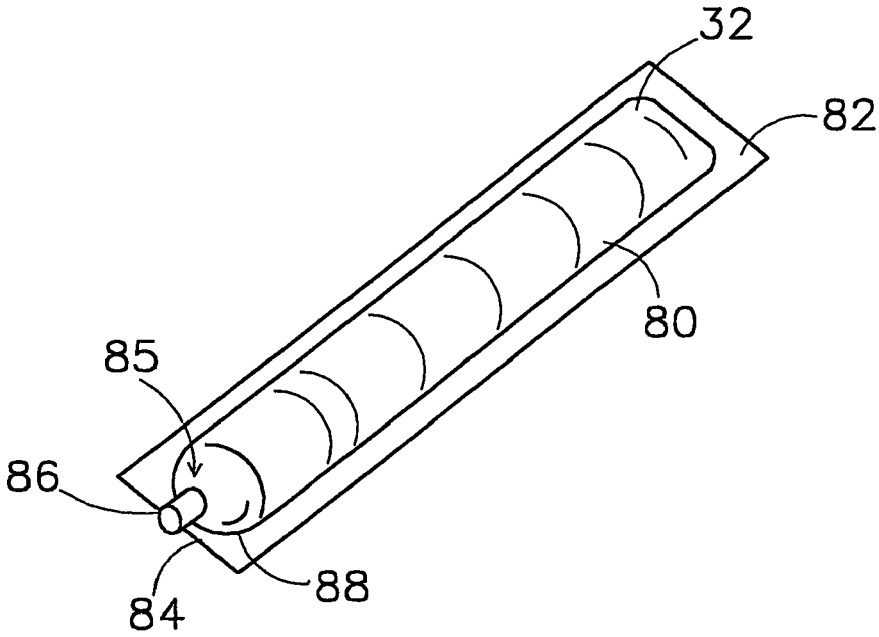
FIG. 3 shows an embodiment of a flexible reservoir for degassed printing medium according to the invention.

FIG. 3 shows an embodiment of a flexible reservoir 32 according to the invention. The flexible reservoir 32 is made from a metalized plastic film which is sufficiently flexible to allow the reservoir to empty out without air entering it. If a multilayer film comprising, for example, outer polyethylene layers with a barrier layer of aluminium between them is used, the barrier layer has the function of on the one hand preventing the printing medium from evaporating during storage and at the same time of preventing the ingress of external air. The reservoir 32 comprises a front surface 80 and rear surface, which are connected to one another in a gas-tight manner along the periphery 82. In a peripheral part 84 there is an outlet opening 85 with a connecting means 86 which can be closed off, for example by means of a cap (not shown). At this peripheral part 84, the securing of the front surface 80 to the rear surface is such that the inner edge 88 of the flexible reservoir 32 merges smoothly into the outlet opening 85. As a result, no printing medium remains behind in the reservoir 32 during printing.

What is claimed is:

1. Printing device for printing on a substrate with a printing medium using the "drop-on-demand" principle, comprising a print head, which is arranged in such a manner that it can be moved to and fro substantially transversely with respect to the direction in which the substrate to be printed is conveyed and has at least one spray nozzle with an interacting piezoelectric element for generating and releasing a drop of the printing medium on demand by generating shockwaves in the printing medium to form said drop of the printing medium, the spray nozzle being in communication with a flexible working container, which is arranged at a fixed position, for degassed printing medium at a working height with respect to the spray nozzle which working height lies within a predetermined height range, in order to keep the pressure of the printing medium within a predetermined pressure range, wherein the working container is in communication with a releasable flexible reservoir for degassed printing medium and wherein the working container and the releasable flexible reservoir have an open connection between them such that during normal operation these form communicating vessels;

wherein the printing device is provided with displacement means for moving the reservoir upwards with respect to the working container; and wherein the displacement means comprise support means for supporting the reservoir, wherein the support means is configured to be tilted towards the working container.

2. Printing device according to claim 1, wherein the reservoir is positioned at a height difference above the working container.

3. Printing device according to claim 1, wherein the support means comprise a support plate, which can rotate about a rotation point located in the vicinity of the end which faces the working container, and at the opposite end is connected to counter-pressure means, and which in the horizontal position bears against supporting means.

4. Printing device according to claim 1, wherein the flexible reservoir is made from a metalized plastic film which is impervious to gas.

5. Printing device according to claim 1, wherein the reservoir has a height dimension and the working container has a height dimension, wherein the height dimension of the reservoir, in the completely filled state, is smaller than the height dimension of the working container.

6. Printing device according to claim 1, wherein the reservoir has a front surface and a rear surface, which are connected to one another along the periphery, an outlet opening with connecting means for coupling to the working container being provided in a peripheral part.

7. Printing device according to claim 1, wherein the open connection between the working container and the releasable flexible reservoir does not contain additional mechanical means during normal operation.

8. Printing device according to claim 1, wherein the degassed printing medium has a maximum oxygen concentration of about 1 mg/l.

9. Printing device according to claim 3, wherein there are signalling means for remote detection of tilting of the support plate.

10. Printing device according to claim 6, wherein the peripheral part is shaped in such a manner that the inner wall of the reservoir has a gradual transition in the direction of the outlet opening.

11. Printing device according to claim 6, wherein the front surface of the reservoir has a length and a width, wherein the ratio of the length of the front surface of the reservoir to its width is greater than 2.5.

12. Printing device according to claim 9, wherein the signalling means are connected to a switch, which is energized in the event of the support plate tilting.

13. Printing device for printing on a substrate with a printing medium using the "drop-on-demand" principle, comprising a print head, which is arranged in such a manner that it can be moved to and fro substantially transversely with respect to the direction in which the substrate to be printed is conveyed and has at least one spray nozzle with an interacting piezoelectric element for generating and releasing a drop of the printing medium on demand by generating shockwaves in the printing medium to form said drop of the printing medium, the spray nozzle being in communication with a flexible working container, which is arranged at a fixed position, for degassed printing medium at a working height with respect to the spray nozzle which working height lies within a predetermined height range, in order to keep the pressure of the printing medium within a predetermined pressure range, wherein the working container is in communication with a releasable flexible reservoir for degassed printing medium and wherein the working container and the releasable flexible reservoir have an open connection between them such that during normal operation these form communicating vessels;

wherein the degassed printing medium has a maximum oxygen concentration of about 1 mg/l;

wherein the printing device is provided with displacement means for moving the reservoir upwards with respect to the working container; and wherein the displacement means comprise support means for supporting the reservoir, wherein the support means is configured to be tilted towards the working container.

14. Printing device according to claim 13, wherein the open connection between the working container and the releasable flexible reservoir does not contain a pump.

15. Printing device according to claim 13, wherein the open connection between the working container and the releasable flexible reservoir does not contain additional mechanical means during normal operation.

* * * * *